US007445538B2

(12) United States Patent
Hanamoto et al.

(10) Patent No.: US 7,445,538 B2
(45) Date of Patent: Nov. 4, 2008

(54) ASSEMBLY UNIT FOR TOY AND MORPHOLOGICALLY DEFORMING TOY

(75) Inventors: Shinichi Hanamoto, Tokyo (JP); Koji Okamoto, Kanagawa (JP); Ryosuke Toriyama, Kanagawa (JP); Shinya Saito, Kyoto (JP); Motokazu Shibasaki, Tokyo (JP); Hachitaro Sato, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 369 days.

(21) Appl. No.: 10/596,630

(22) PCT Filed: Dec. 17, 2004

(86) PCT No.: PCT/JP2004/018953

§ 371 (c)(1),
(2), (4) Date: Jun. 19, 2006

(87) PCT Pub. No.: WO2005/058447

PCT Pub. Date: Jun. 30, 2005

(65) Prior Publication Data

US 2007/0167108 A1 Jul. 19, 2007

(30) Foreign Application Priority Data

Dec. 19, 2003 (JP) ..... 2003-423874

(51) Int. Cl.
*A63H 3/46* (2006.01)

(52) U.S. Cl. ..... 446/390; 446/321; 446/376; 446/383

(58) Field of Classification Search ..... 446/321, 446/330, 376, 378, 383, 390, 487
See application file for complete search history.

(56) References Cited

U.S. PATENT DOCUMENTS

| | | | | |
|---|---|---|---|---|
| 4,411,097 | A * | 10/1983 | Murakami | 446/376 |
| 4,516,948 | A * | 5/1985 | Obara | 446/95 |
| 6,089,950 | A * | 7/2000 | Lee et al. | 446/376 |
| 6,375,536 | B1 * | 4/2002 | Yang | 446/353 |
| 6,482,068 | B2 * | 11/2002 | Lee et al. | 446/376 |

(Continued)

FOREIGN PATENT DOCUMENTS

| | | |
|---|---|---|
| JP | 62-74869 | 5/1988 |

(Continued)

*Primary Examiner*—John Ricci
(74) *Attorney, Agent, or Firm*—Rankin, Hill & Clark LLP

(57) ABSTRACT

To provide an assembly unit for a toy capable of storing unused engaging section in a part unit thereof. An arm part (13) of the toy comprises a rotating member (50) rotating about a rotating shaft (55) provided in the body (14) thereof. The rotating member (50) has an engaging section (53), which is used for connecting the rotating member to a second part unit (23), which is connected to the arm part (13), and a hand (necessary member) (51). When a separate member (23) is connected to the arm part (13), the hand 51 is stored in the body 14 and the engaging section (53) is exposed to the outside of the body (14). When the separate member (23) is not connected to the arm part (13), the engaging section (53) is stored in the body (14) and the hand (51) is exposed to the outside of the body (14).

18 Claims, 13 Drawing Sheets

U.S. PATENT DOCUMENTS

| | | | | |
|---|---|---|---|---|
| 6,491,567 | B2 * | 12/2002 | Chan | 446/478 |
| 6,568,984 | B1 * | 5/2003 | Applewhite | 446/176 |
| 6,679,749 | B2 * | 1/2004 | Yu | 446/71 |
| 6,805,606 | B1 * | 10/2004 | Kellum | 446/176 |

FOREIGN PATENT DOCUMENTS

| | | |
|---|---|---|
| JP | 09-028933 | 2/1997 |

* cited by examiner

ASSEMBLY UNIT FOR TOY AND MORPHOLOGICALLY DEFORMING TOY

TECHINICAL FIELD

The present invention relates to an assembly unit for a toy, which comprises a first part unit and a second part unit connected to each other via a detachable connecting mechanism, and to a transformable toy, which is constructed using the assembly unit for the toy and transforms its figure.

RELATED ART

In a conventional transformable toy disclosed in the Japanese Patent Publication No. 3152591, a plurality of part units are connected to each other via a detachable connecting mechanism. In the conventional transformable toy, when one part unit is removed from another part unit, basically, engaging section constituting a part of the connecting mechanism is left being exposed to the outside. Also in a toy for forming a predetermined three-dimensional object by assembling blocks or the like having various shapes, particularly, male or projecting type engaging sections are left as they are being exposed to the outside.

Patent document 1: Japanese Patent Publication No. 3152591

DISCLOSURE OF THE INVENTION

Problem to be Solved by the Invention

In the conventional structure, when the engaging section of a part unit is not connected to another part unit, the engaging section is exposed to the outside resulting in such a disadvantage as disfigurement.

An object of the present invention is to provide an assembly unit for a toy and a transformable toy capable of receiving unused engaging section within the part unit.

Another object of the present invention is to provide an assembly unit for a toy and a transformable toy equipped with a highly strong engaging portion having a convex part as the engaging section.

Further another object of the present invention is to provide an assembly unit for a toy and a transformable toy of which engaging section can be easily stored and taken out.

Means for Solving the Problems

The present invention relates to an assembly unit for a toy that comprises a first part unit and a second part unit connected to each other via a connecting mechanism including an engaging section formed at the first part unit and an engaged section, provided at the second part unit, the engaged portion has such a structure that the engaging section detachably engages with the engaged section. The first part unit used in the present invention has a rotating member, which rotates about a rotating shaft provided in a body of the part unit. The rotating member is provided with the engaging portion and a necessary member that, when the first part unit and the second part unit are not connected to each other, constitutes a necessary part of the first part unit. The first part unit is structured so that the rotating member can selectively rotate between the first position and the second position. Here, the wording "first position" means a position where, when the first part unit and the second part unit are connected to each other, the necessary member is received within the body and the engaging section is exposed to the outside of the body. On the other hand, the wording "second position" means a position where, when the first part unit is not connected to the second part unit, the engaging section is received within the body and the necessary member is exposed to the outside of the body. According to the present invention, when the second part unit is connected to the first part unit, the rotating member Is rotated to the first position so that the engaging section is exposed to the outside of the body. And when the second part unit is not connected to the first part unit, the rotating member is rotated to the second position so that the necessary member is exposed to the outside of the body. Therefore, according to the present invention, when the second part unit does not have to be connected to the first part unit, only by rotating the rotating member, the engaging section is received within the body of the first part unit. As a result, the engaging section is not seen from the outside can be obtained without using another part unit. Accordingly, the appearance of the first part unit actually used can be enhanced.

The engaging section, which is provided at the first part unit, may be arbitrarily structured. As the engaging section, one of the engaging portion having the convex part and an engaging portion having a concave part to be detachably engaged with the engaging portion having the convex part may be used. In this case, the portion to be engaged, which is formed in the second part unit, is the other one of the engaging portion having the convex part and the engaging portion having the concave part.

An arbitrary configuration may be employed for the engaging portion having the convex part. For example, the engaging portion having a convex part may comprise a base provided to the rotating member, a plate-like portion formed integrally with the base extending in the direction in which the plate-like portion extends away from the base, and an engaging-expanding portion formed integrally with the plate-like portion along the end thereof may be employed. When the engaging portion having the convex part as described above is employed, as for the corresponding engaging portion having a concave part, the following structure may be employed. That is, the engaged portion having the concave part may comprise a pair of flexible wall portions disposed at a predetermined distance from each other so as to sandwich the plate-like portion and the engaging-expanding portion of the engaging portion having the convex part; and an engaged-expanding portion integrally formed along the end portion of the pair of wall portions so as to prevent the engaging-expanding portion from coming off therebetween. Such connecting mechanism having the concavity and convexity relationship as described above, which is constructed of the engaging portion having the concave part and the engaging portion having the convex part, has been generally employed. However, when the replacement frequency is increased, particularly, the plate-like portion of the engaging portion having the convex part may be deformed, or in the worst case, may be broken. Therefore, the engaging portion having the convex part may further comprise formed with a reinforcement portion, which is connects the base and the plate-like portion to mechanically reinforce the plate-like portion. The reinforcement portion being formed so as to permit the plate-like portion and the engaging-expanding portion to be inserted between the pair of wall portions of the engaging portion having the concave part. By arranging as described above, owing to the reinforcement portion, the plate-like portion of the engaging portion having the convex part is reinforced and the life of the engaging portion having the convex part can be largely increased.

Although the body of the first part unit may be arbitrarily structured, the following structure is preferred. That is, the body may have a hollow structure including a receiving space therein for receiving the necessary member or the engaging section. And inside the body, a rotating shaft is provided. Also, the peripheral wall portion surrounding the receiving space of the body is formed so as to permit the rotating member to change its position about the rotating shaft between the first position and the second position. By arranging as described above, when the rotating member is positioned at the second position, the engaging portion is enclosed by the peripheral wall portion of the body, thereby the engaging section can be hardly seen from the outside.

Note that a part of the peripheral wall portion may be constructed of a door member, which is opened at least in one of the following cases; i.e., when the rotating member is rotated from the first position to the second position about the rotating shaft; and when the rotating member is rotated from the second position to the first position about rotating shaft so as to permit the rotation of the rotating member. In the case where the part of the peripheral wall portion is constructed of the door member as described above, even when the shape and the dimension of the peripheral wall portion of the body is reduced as small as possible, when the rotating member is rotated, the door member can be opened so as to permit the rotation of the rotating member. Thus, the external shape of the body can be made compactly.

In the case where the assembly unit for toy of the present invention is applied to a transformable toy, the assembly unit for toy of the present invention has to be used at least a part the transformable toy. Even only in a part, when the engaging section can be received, the appearance of the transformable toy after transformation can be enhanced. Further, since another part unit does not have to be connected to conceal the engaging section, the transformable toy can be constructed using a fewer component parts.

The transformable toy of the present invention is a transformable toy that comprises a plurality of part units connected to each other via a connecting mechanism each including an engaging section and an engaged section having such a structure that the engaging section is engaged therewith. The transformable toy transforms its figure by changing the connecting combination among a plurality of part units; by replacing previously prepared separate part units with a part of a plurality of part units using the connecting mechanism; or by adding previously prepared part units to a plurality of part units using the connecting mechanism. In the transformable toy, one part unit, which is connected via the connecting mechanism, includes rotating member having a necessary member that, when the one part unit is not connected to another one part unit, constitutes a necessary portion of the one part unit. The rotating member rotates about the rotating shaft provided to the body of the one part unit. The rotating member is provided with the engaging section. The one part unit is structured so that the rotating member is selectively rotatable about the rotating shaft between a first position and a second position. The rotating member is at the first position where the necessary member is received within the body and the engaging section is exposed to the outside of the body when one part unit and other part unit are connected to each other, a second position where the engaging section is received in the body and the necessary member is exposed to the outside of the body when the one part unit and the other part unit are not connected to each other. For example, the one part unit itself may construct an arm part. In this case, the necessary member is a hand.

BEST MODE FOR CARRYING OUT THE INVENTION

Figure 1:
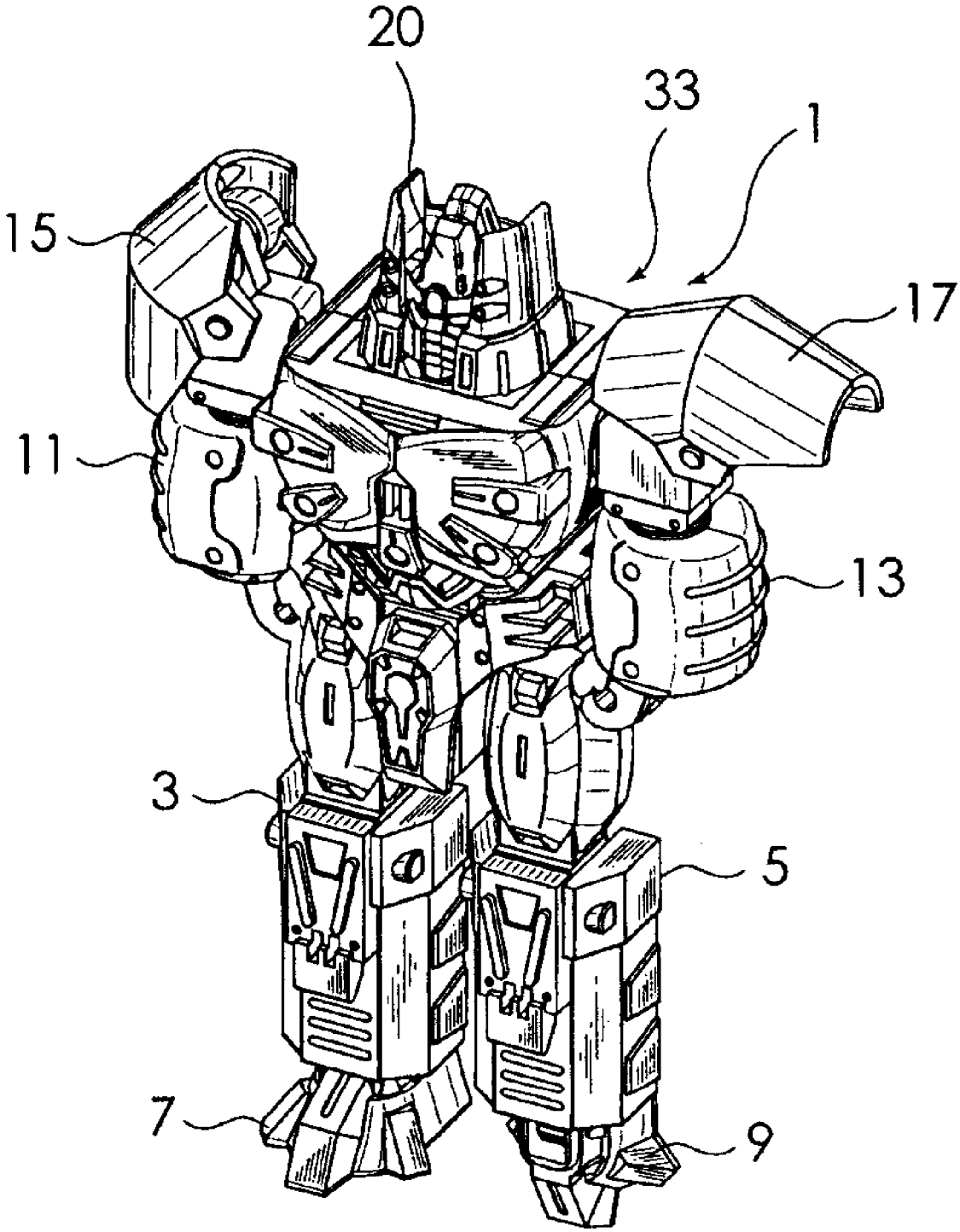
FIG. 1 is a perspective view showing a state of transformation in one embodiment of a transformable toy to which a toy assembly unit of the present invention is applied.
Figure 2:
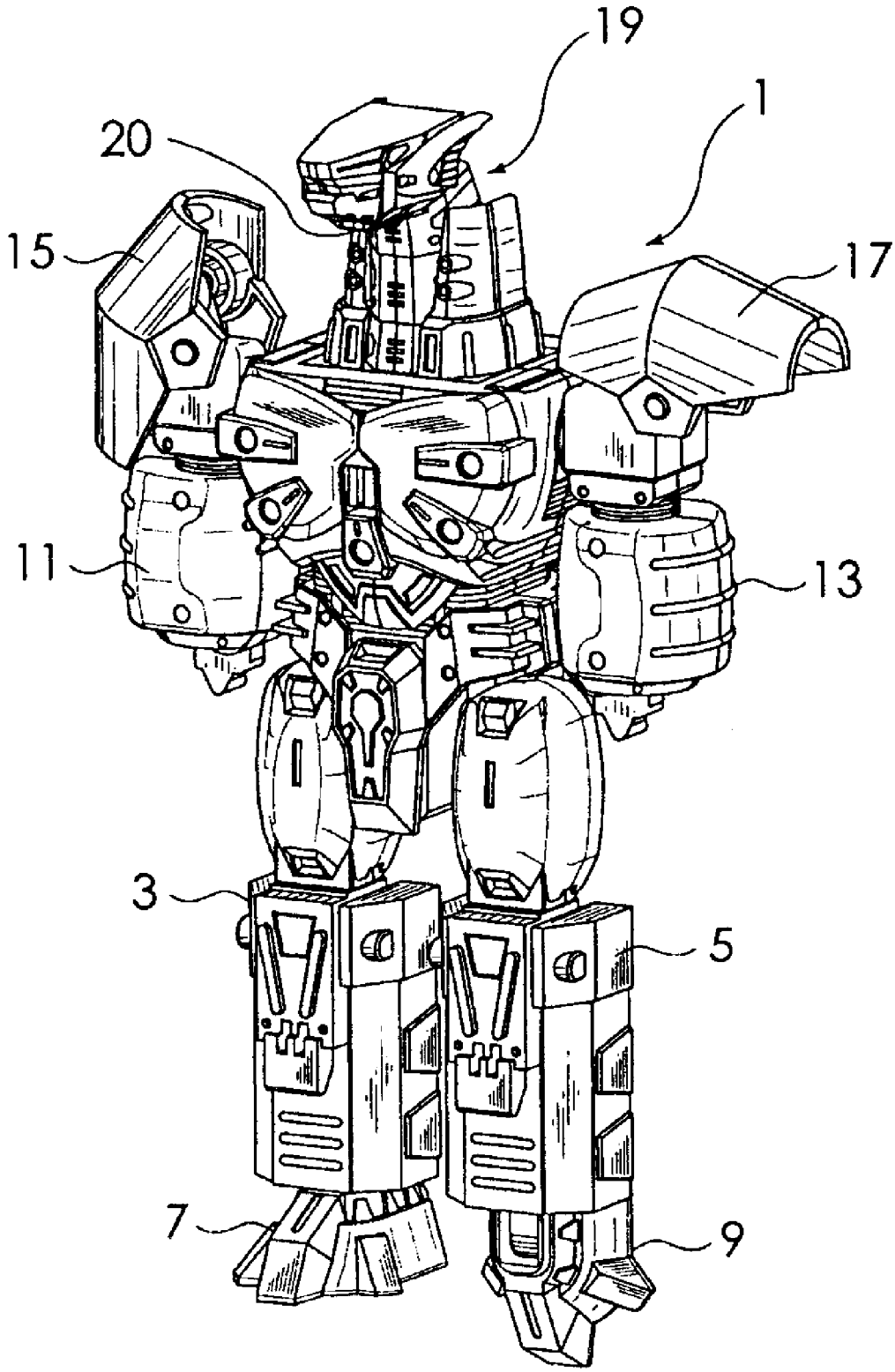
FIG. 2 is a perspective view showing a state of transformation in one embodiment of the transformable toy to which the toy assembly unit of the present invention is applied.
Figure 3:
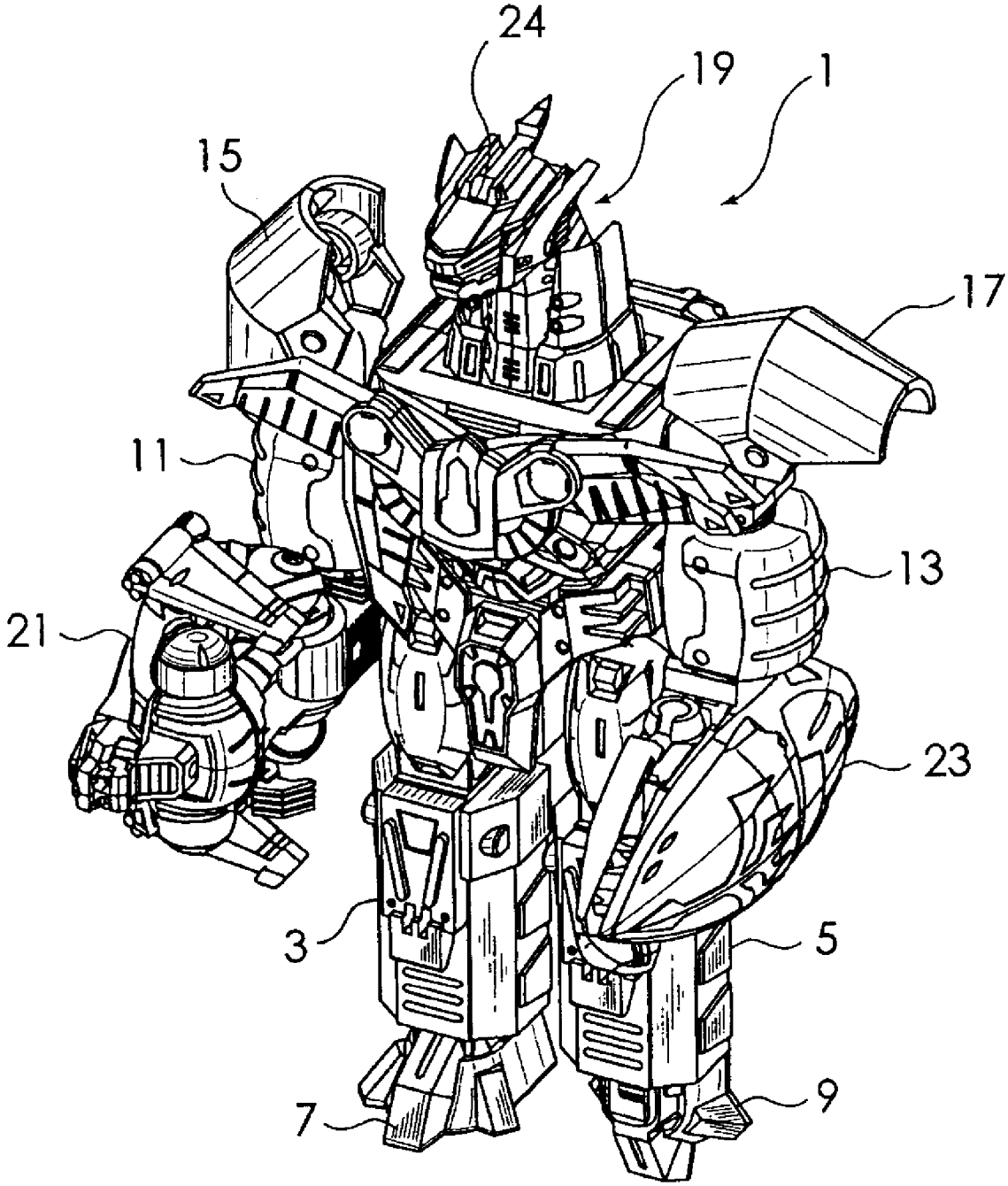
FIG. 3 is a perspective view showing a state of transformation in one embodiment of the transformable toy to which the toy assembly unit of the present invention is applied.
Figure 4:
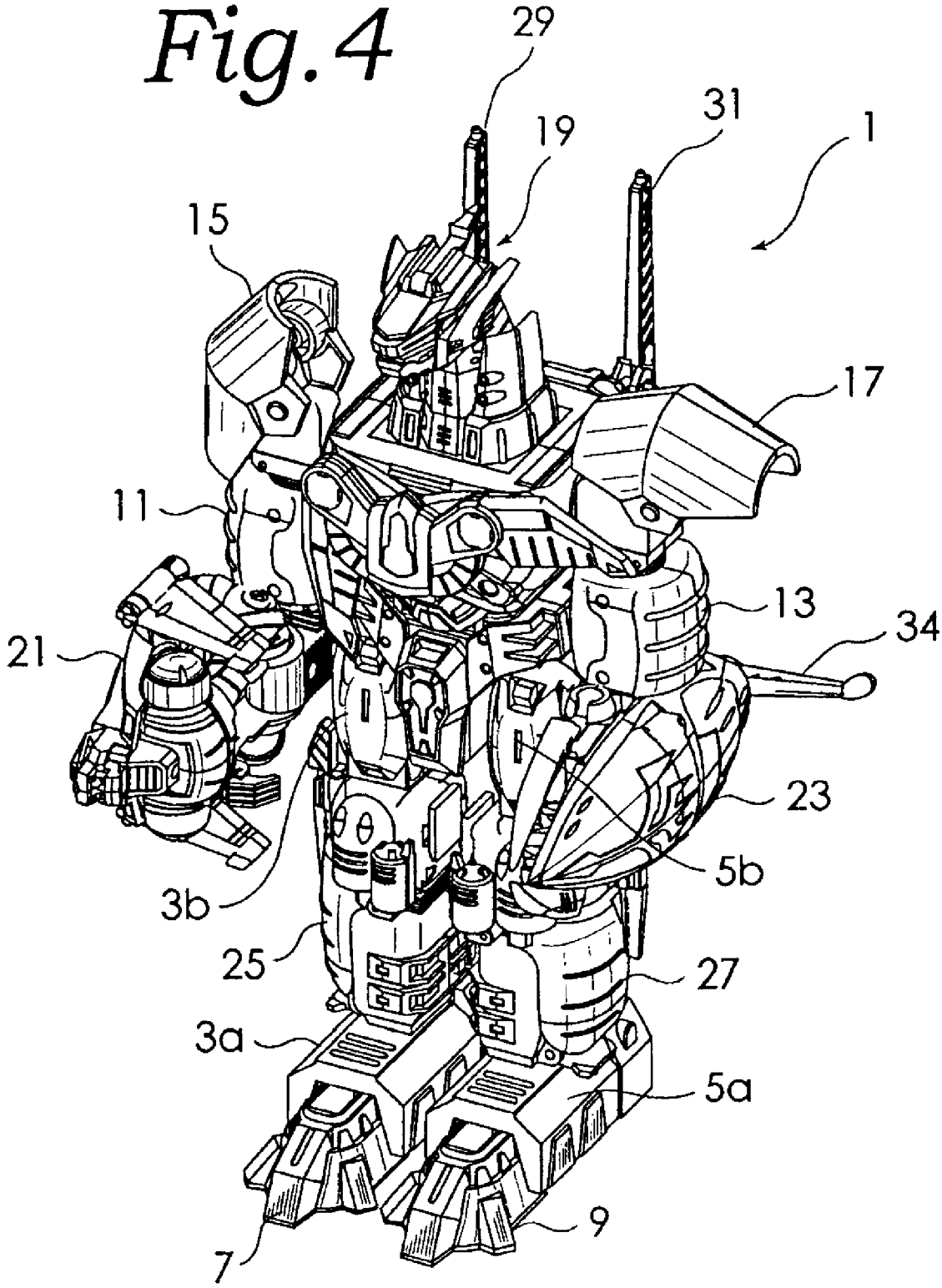
FIG. 4 is a perspective view showing a state of transformation in one embodiment of the transformable toy to which the toy assembly unit of the present invention is applied.

Embodiments of the present invention will be described in detail below with reference to the drawings. FIGS. 1 to 4 are perspective views each showing a state of transformation of an embodiment in which a toy assembly unit of the present invention is applied to a transformable toy. The transformable toy to which the present invention is applied is a so-called robot toy. As shown in FIG. 1, foot sections 7 and 9 are provided to the end of two leg sections 3 and 5 of a robot toy 1, and the left foot section 9 is transformed into a state of standing on tiptoe. Also, the covers 15 and 17 cover the shoulders positioned on two arms 11 and 13, the cover 17 on the left shoulder is transformed into a lifted state. Comparing with FIG. 1, a neck section 19 shown in FIG. 2 is elongated or expanded, and thus the shape of a head section is transformed. For the expansion and contraction of the neck section 19, there is employed an expansion and contraction structure for transformable toy. Comparing the state shown in FIG. 2 to the state shown in FIG. 3, there is a difference in that one member constituting the arm parts 11 and 13; i.e., the first part units are connected to other members; i.e., part units 21 and 23 via a connecting mechanism respectively. This connecting mechanism will be described in detail later. Comparing the state shown in FIG. 3 to the state shown in FIG. 4, there is a difference in that the shape of the leg sections is different therefrom; a point that the robot has/does not have a tail; and a point that a weapon is attached to the back thereof. In the state shown in FIG. 4, the leg sections 3 and 5 shown in FIG. 3 are separated from the femoral regions 3*b* and 5*b* at the cnemis sections 3*a*, 5*a* respectively; the femoral regions 3*b*, 5*b* are connected with part units 25 and 27 via a connecting mechanism respectively. Then the original parts below the cnemis sections 3*a*, 5*a* are connected to the part units 25 and 27, respectively. The foot sections 7 and 9 are transformed into a straightened state with respect to the cnemis sections 3*a*, 5*a*. Since the shape of the foot section becomes larger, a satisfactorily stable state is obtained, compared with the state shown in FIG. 3, in the transformation mode shown in FIG. 4.

In this robot toy, by connecting the part units 21, 23, 25, 27 to the arm parts 11, 13 and the femoral regions 3*b*, 5*b*, the figure thereof is largely changed. Since the structure of the arm parts 11, 13 are substantially the same, description will be made as to the structure in which the second part unit 23 (FIG. 3, FIG. 4) is connected to the arm part 13. In the robot toy 1, the arm part 13 is connected with the second part unit 23, which is obtained by disassembling a part of another robot toy, via the connecting mechanism. The connecting mechanism comprises an engaging section, which is provided at the arm part (first part unit), and an engaged section, which is provided at the second part unit 23 and has such a structure that the engaging section is detachably engaged therewith.

Figure 5:
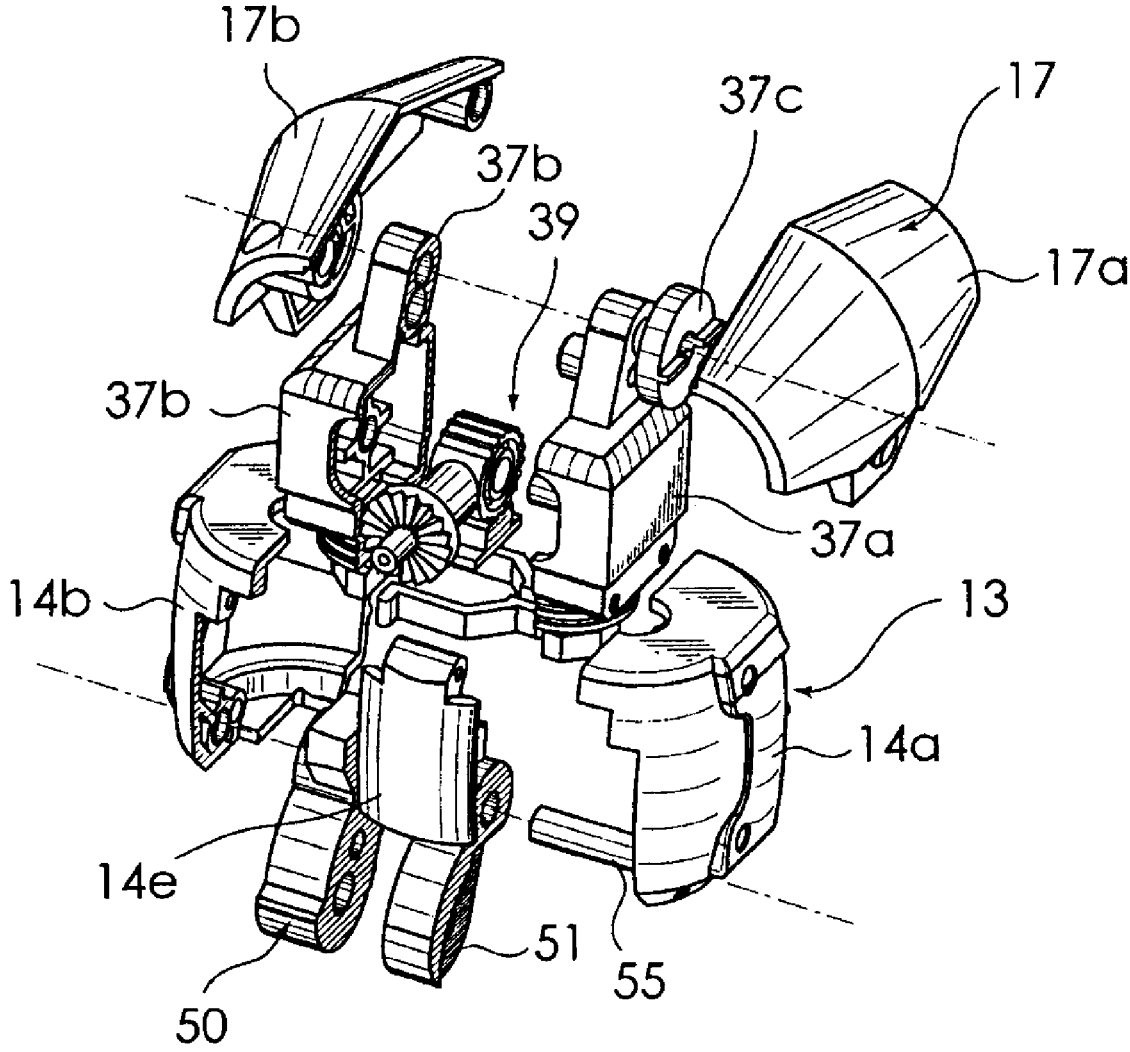
FIG. 5 is an exploded perspective view of a left arm.
Figure 6:
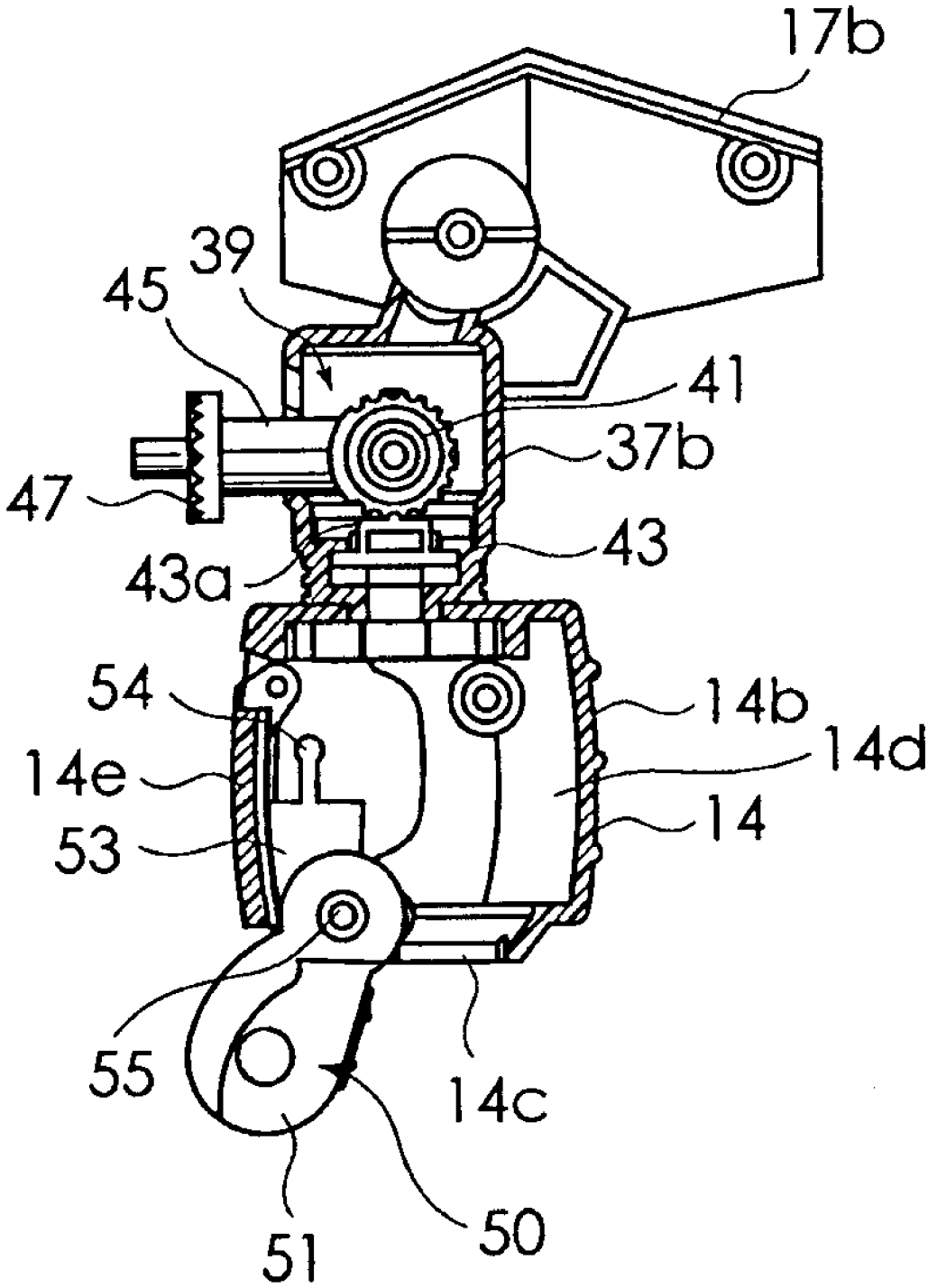
FIG. 6 is an illustration showing a half part of the left arm.
Figure 7:
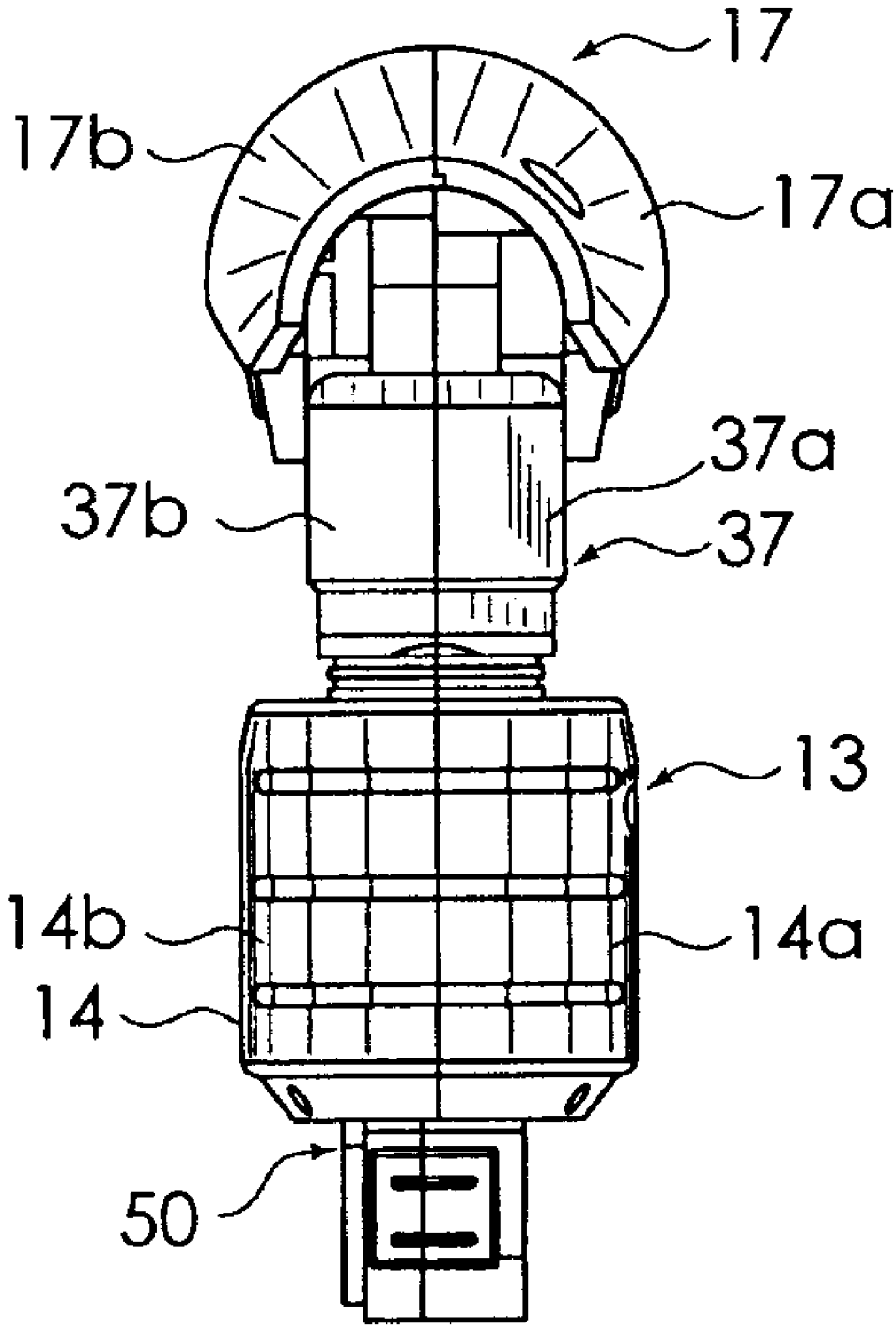
FIG. 7 is a rear elevation view of the left arm.

FIG. 5 is an exploded perspective view showing the exploded structure of the left arm; FIG. 6 is an illustration showing a half part of the left arm; and FIG. 7 is a back view of the left arm in an assembled state in which the members shown in FIG. 5 are assembled. Every exterior part including the cover 17 is divided into two parts. The cover 17 comprises two cover half parts 17*a* and 17*b*. Below the cover half parts 17*a* and 17*b*, a mechanism case 37 is positioned. Inside of the mechanism case 37, a click mechanism 39, which gives a feeling of clicking when the arm is moved rightward/leftward, is received. The cover half parts 17*a* and 17*b* are rotatably attached to attached portions 37*c* and 37*d* formed on the mechanism case half parts 37*a* and 37*b*. The click mechanism 39 comprises a gear-like member 41 formed with concavities and convexities on the periphery thereof and a click-spring holding member 43, which rotates on the periphery of the gear-like member 41. The click-spring holding member 43 has a leaf spring 43*a* having a projection, which is engaged with the concavities and convexities on the periphery of the gear-like member 41 by means of a spring force of its own. The gear-like member 41 is integrally attached to one end of a shaft 45; and to the other end of the shaft 45, a gear-like member 47 of another click mechanism is integrally provided for generating a feeling of clicking when the arm part is rotated forward/backward.

Figure 8:
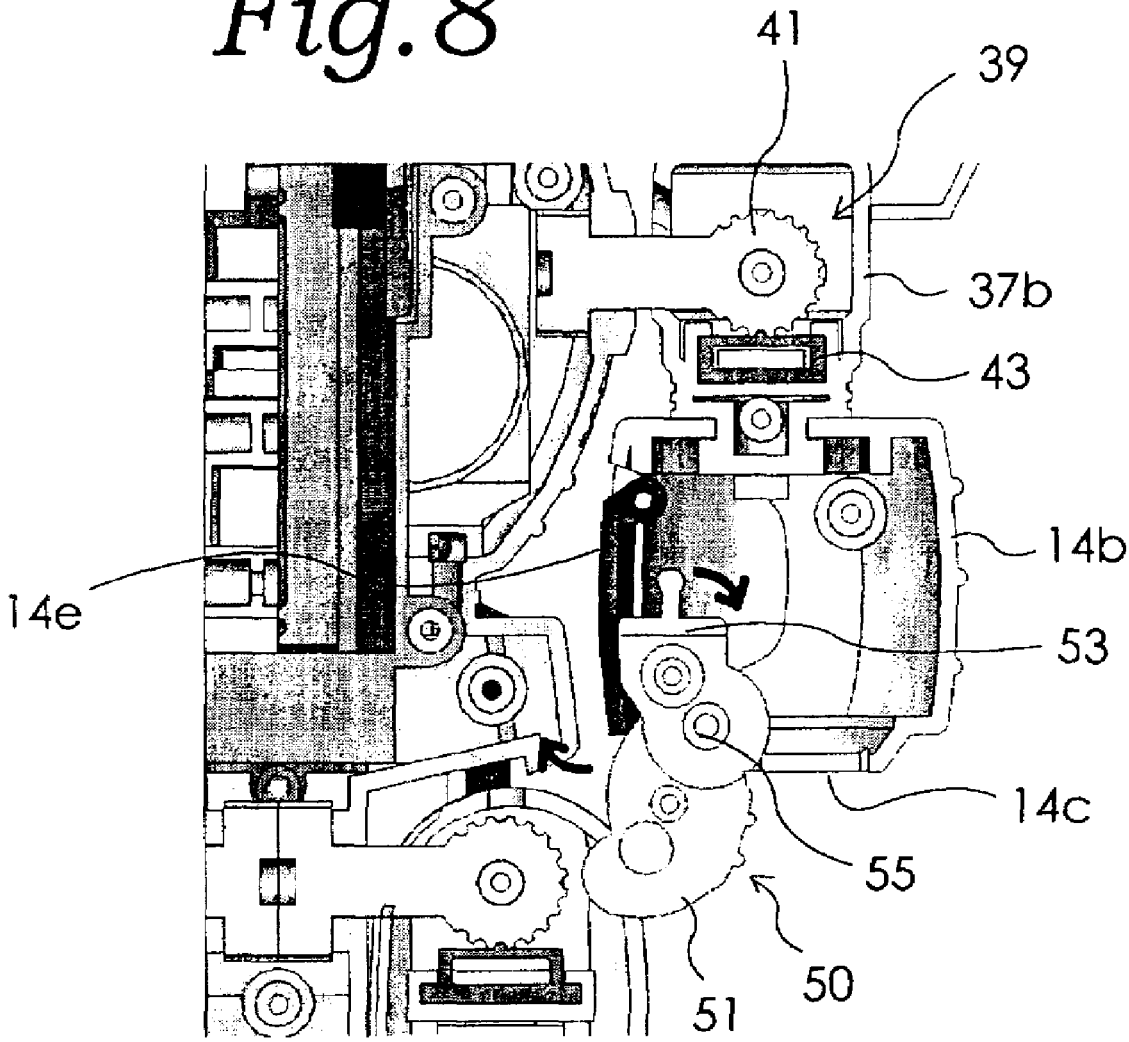
FIG. 8 is an illustration of a state that a rotating member is at a second position.
Figure 9:
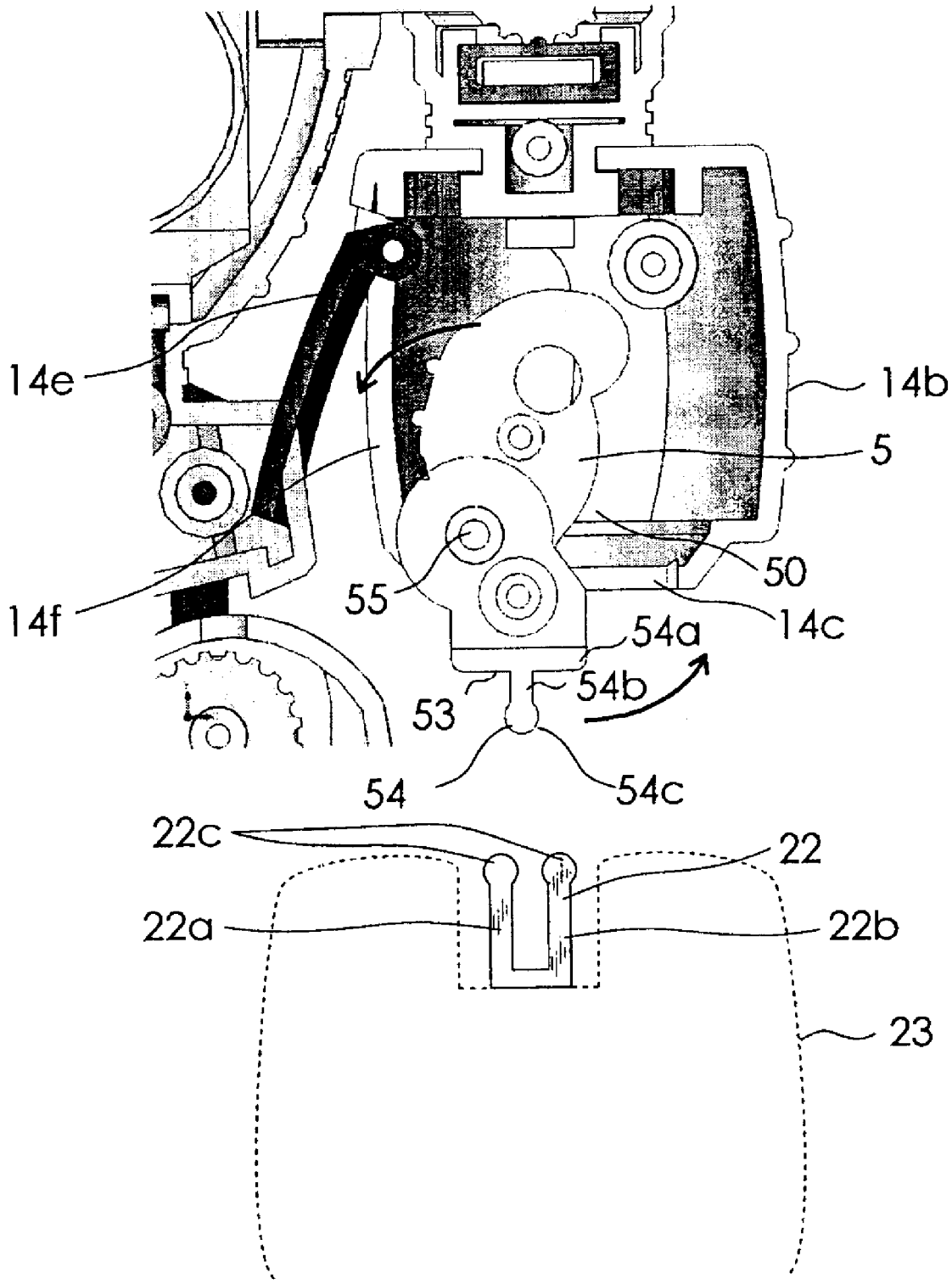
FIG. 9 is an illustration of a state that the rotating member is at a first position.

Below the mechanism case 37, a body 14 of the arm part 13 is provided. The body 14 has a hollow structure, and is constructed of two body half parts 14*a* and 14*b* and a door member 14*e*, which will be described later, in a combination with each other. In particular, the body 14 has an opening 14*c*, which opens to the outside, and has a receiving space 14*d* for receiving a hand 51 (necessary member) or an engaging section 53 of the robot provided to a rotating member 50 therein. The body 14 is provided with a rotating shaft 55 in the vicinity of the opening section 14*c*. A rotating member 50 is rotatably attached with the rotating shaft 55. The rotating shaft 55 has such a structure that one end thereof is fixed to the body half part 14*a* and the other end thereof is engaged with the body half part 14*b*. The door member 14*e* is supported so that the both upper ends thereof are swingable with respect to the body half parts 14*a* and 14*b*. The rotating member 50 rotates about the rotating shaft 55 between a first position, where a state that the hand (necessary member) is received within the body 14 and the engaging section 53 is exposed to the outside of the body 14, and a second position, where the engaging section 53 is received in the body 14 and the hand (necessary member) is exposed to the outside of the body 14. FIG. 9 illustrates a state that the rotating member 50 is positioned at the first position; and FIG. 8 illustrates a state that the rotating member 50 is at the second position. As shown in FIG. 8, when the rotating member 50 is at the second position, since the engaging section is surrounded by the peripheral wall portions (14*a*, 14*b*, 14*e*) of the body 14, the engaging section can be hardly seen from the outside. Note that the size of the opening 14*c* is prescribed so that the engaging section 53 can come in/out of the storage space 14*d* through the opening 14*c*. Also, the size of the door member 14*e* is prescribed so that when the door member 14*e* is in an opened state, the rotating member 50 can come in/out of the receiving space 14*d* through a window section 14*f* (FIG. 9), which is closed by the door member 14*e*.

In this embodiment, when the second part unit 23 (FIG. 3 and FIG. 4) is connected to the arm part 13, the rotating member 50 is rotated to the first position (the position shown in FIG. 9) to expose the engaging section 53 to the outside of the body 14. When the second part unit 23 is not connected to the arm part 13, the rotating member 50 is rotated to the second position (the position shown in FIG. 7) to expose the hand (necessary member) to the outside of the body 14. As a result, according to this embodiment, when the second part unit 23 does not have to be connected to the arm part 13 as the first part unit, only by rotating the rotating member 50, the engaging section 53 is received in the body 14 of the first part unit to obtain a state that the engaging section 53 can not be seen from the outside. Further, when the second part unit 23 is connected, without removing the arm part 13, the rotating member 50 is rotated to expose the engaging section 53 to the outside as shown in FIG. 9, and the engaging portion having the concave part 22 of the second part unit 23 can be engaged with the engaging section 53 exposed to the outside.

The engaging section 53 provided to the rotating member 50 of the arm part 13 may be arbitrary structured. In this embodiment, an engaging portion having a convex part 54 is used as the engaging section 53 as shown in FIG. 9. However, it should be noted that an engaging portion having a concave part (the same thing as the engaging portion having the concave part 22 provided at the second part unit 23), which is detachably engaged with the engaging portion having the convex part, may be used as the engaging section 53. In this case, the engaged section, which is provided at the second part unit 23 should be the engaging portion having the convex part.

The engaging portion having the convex part 54 in this embodiment has such a structure that comprises a base 54*a* provided on the rotating member 50, a plate-like portion 54*b* formed integrally with the base 54*a* extending in the direction (perpendicular direction) in which the plate-like portion 54*b* extends away from the base 54*a*, and a engaging-expanding portion 54*c* formed integrally with the plate-like portion 54*b* along the end of the plate-like portion 54*b*. When adopting the engaging portion having the convex part 54 as described above, as for the corresponding engaging portion having the concave part 22, the following structure may be adopted. That is, a pair of flexible wall portion 22*a*, 22*b*, which are disposed at a predetermined distance from each other, for sandwiching the plate-like portion 54*b* and the engaging-expanding portion 54*c* of the engaging portion having the convex part 54, and which is integrally formed with engaging portion having the concave part expanding sections 22*c* along the end thereof to prevent the engaging-expanding portion 54*c* from coming off therebetween. Such connecting mechanism comprising the engaging portion having the concave part 22 and the engaging portion having the convex part 54 in the relationship of concavity and convexity as described above has been generally used. However, when the disassembling and assembling are made so frequently, particularly the plate-like portion 54*b* of the engaging portion having the convex part 54 may be deformed or broken in the worst case.

Figure 10:
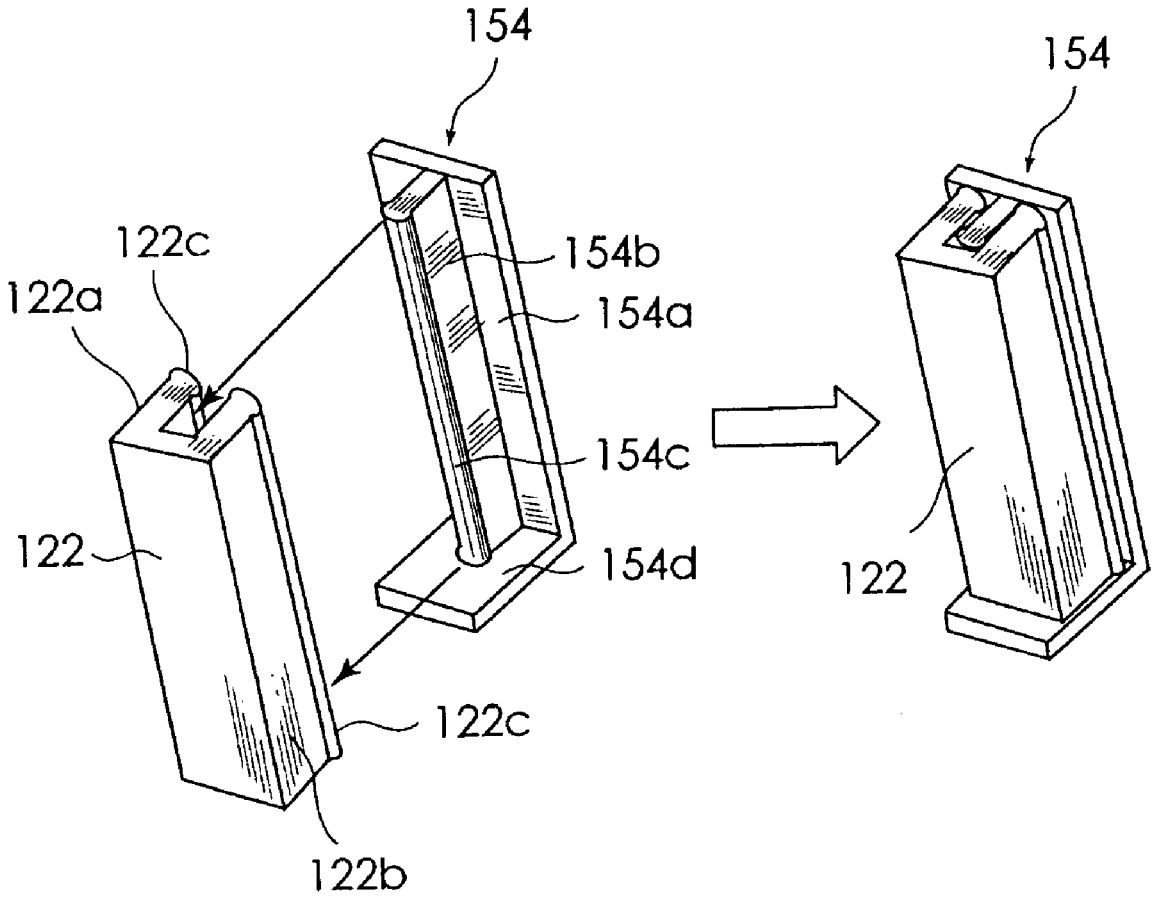
FIG. 10 is a view for illustrating a modification of an engaging portion having a convex part.

Therefore, as shown in FIG. 10, it is preferred to use the engaging portion having the convex part 154 provided with a reinforcement portion 154*d*, which is disposed bridging between the base 154*a* and the plate-like portion 154*b* to mechanically reinforce the plate-like portion 154*b*. The reinforcement portion 154*d* has to be formed so as to permit the plate-like portion 154*a* and the engaging-expanding portion 154*c* to be inserted between the pair of wall portion 122*a* and 122*b* of the engaging portion having the concave part 122. By arranging as described above, owing to the existence of the reinforcement portion 154*d*, the plate-like portion 154*b* of the engaging portion having the convex part 154 is reinforced, and the life of the engaging portion having the convex part 154 can be largely increased. In addition, the reinforcement portion 154*d* can prevent the plate-like portion 154*b* from breaking, even when a force is applied to the part unit from the outside and a relatively large load is applied to the engaging portion having the convex part 154 after the engaging portion having the convex part 154 is engaged with the engaging portion having the concave part 122.

Figure 11:
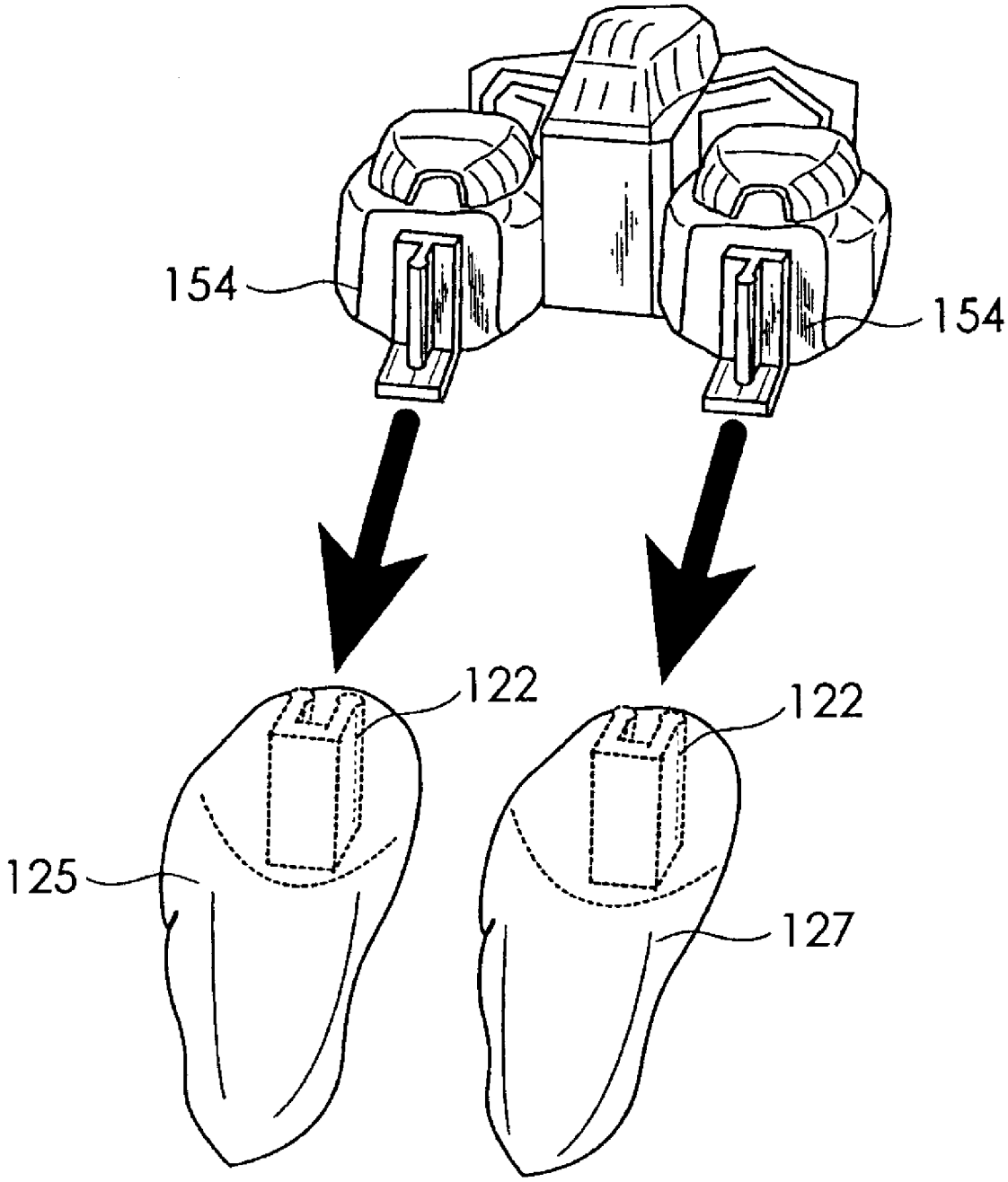
FIG. 11 is a perspective view for illustrating the engaging portion having the convex part provided with a reinforcement portion, which connects a separate member to a femoral region.

In the above embodiment, the description has been made about the arm part 13 in detail. The structure of the arm part 11, however, is also the same as that of the arm part 13. Further, the femoral regions 3*b*, 5*b* (refer to FIG. 4) of the leg sections 3 and 5 are provided with the same kind of engaging portions having a convex part 54 as described above. Therefore, it is needless to say that, as shown in FIG. 11, the engaging portion having the convex parts 154, 154 provided at the femoral regions 3*b*, 5*b* of the leg sections 3 and 5 also may use the engaging portion having the convex part 154 provided with a reinforcement portion 154*d* shown in FIG. 10.

In the above embodiment, the separate member (second part unit) is connected to the arm part (first part unit) of the robot toy via a connecting mechanism. However, the present invention is not limited to the above embodiment, but may be applied to any member constituting the transformable toy. In the case where a separate member (second part unit) is connected to any member (first part unit) of a leg section, a foot section, a body section, a head section and the like, the present invention can be applied thereto. Needless to say that members removed from the transformable toy is also included in the separate member (second part unit).

Figure 12:
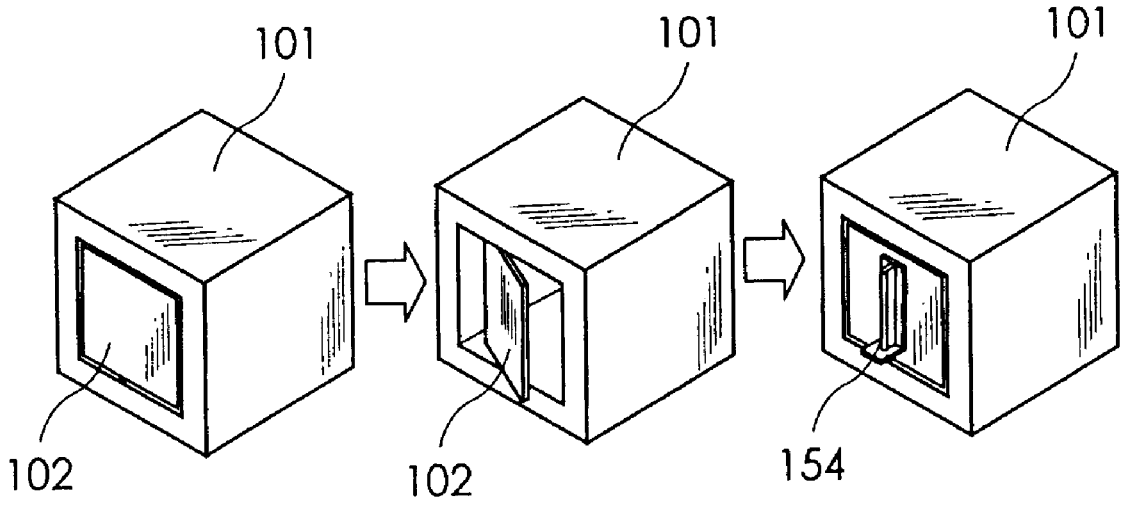
FIG. 12 is a view for illustrating a mode of transformation of a part unit when the present invention is applied to a assembly unit for a block toy.
Figure 13:
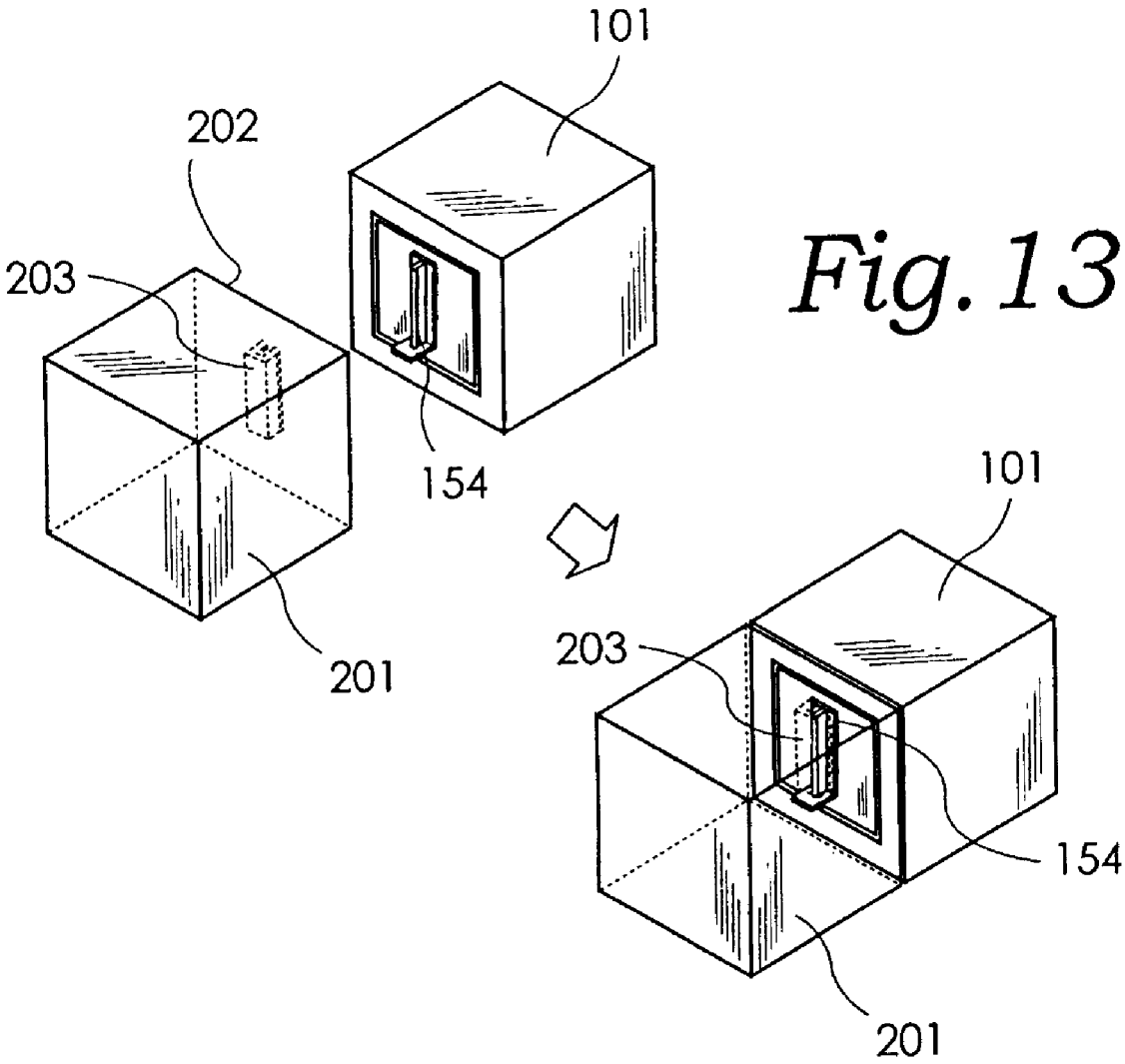
FIG. 13 is a view showing the connected state between two part units in the case where the present invention is applied to the assembly units for the block toy.

FIG. 12 illustrates, as an example operation steps for exposing an engaging section of a part unit which is used in a block toy that the present invention is applied. At one side of a first part unit 101, a wall 102 is provided as a necessary member so as to rotate about a rotation shaft (not shown). On the rear face of the wall 102, an engaging portion having a convex part 154 is provided as the engaging section. As shown in FIG. 13, the connection between the first part unit 101 and the second part unit 201 is completed by fitting engaging portion having a convex part 154 of the first part unit 101 into the engaging portion having the concave part 203 provided at the second part unit 201. Note that, in the second part unit 201 also the engaging portion having the concave part 203 may be received in the second part unit 201, whereby the thickness of the wall 202 provided with the engaging portion having the concave part 203 is thicker than the thickness of the engaging portion having the concave part 203, and the wall is entirely rotatable.

Characteristics of the transformable toy disclosed in this description will be summarized below.

(1) A transformable toy comprises a plurality of members connected to each other via a connecting mechanism, in which other member is further connected to at least one member of the plurality of members via a connecting mechanism to change its figure, and the connecting mechanism is constituted of an engaging section provided at the one member and an engaged portion, which is provided at the other member and has such a structure that the engaging section is detachably engaged therewith, wherein the one member has a rotating member, which rotates about a rotating shaft provided to the body thereof, wherein the rotating member is formed with a necessary member, which constitutes a necessary portion of the one member when the rotating member is used in a state not connected to another member, and the engaging section, wherein the one member is structured so that the rotating member selectively rotates about the rotating shaft between a first position where, when the one member and the other member are connected to each other, the necessary member is received in the body and the engaging section is exposed to the outside of the body, and a second position where, when the one member is used in a state not connected to the other member, the engaging section is received in the body and the necessary member is exposed to the outside of the body.

(2) The transformable toy set forth in the above (1), wherein the engaging section is one of an engaging portion having a convex part and the engaging portion having the concave part that detachably engages with the engaging portion having the convex part, and the engaged section is the other of the engaging portion having the convex part and the engaging portion having the concave part. (3) The transformable toy set forth in the above (1), wherein the body has an opening section, which opens to the outside, and having a hollow structure including a receiving space therein for receiving the necessary member or the engaging section, wherein the rotating shaft is provided to the body in the vicinity of the opening section, and wherein the opening section of the body and the peripheral wall portion surrounding the receiving space of the body are structured so as to allow the rotating member to change its position between the first position and the second position about the rotating shaft.

(4) The transformable toy set forth in the above (3), wherein a part of the peripheral wall portion is constructed from a door member that is opened at least in one of the cases that the rotating member rotates from the first position to the second position about the rotating shaft and that the rotating member rotates from the second position to the first position about the rotating shaft to allow the rotating member to rotate.

INDUSTRIAL APPLICABILITY

By employing the toy assembly unit of the present invention, when a second part unit which is connectable does not have to be connected to a first part unit, only by rotating a rotating member, an engaging section can be received in the body of the first part unit, and further, a necessary member necessary for the part unit can be exposed to the outside of the first part unit. Therefore, the appearance of the toy constructed in a combination with the part units can be completed to a further beautiful state.

The invention claimed is:

1. An assembly unit for a toy comprising a first part unit having a rotating member rotating about a rotating shaft provided to a body thereof, a second part unit, and a connecting mechanism constituted of an engaging section provided at the first part unit and a engaged section provided at the second part unit having such a structure that the engaging section detachably engages therewith, the rotating member being provided with the engaging section and a necessary member, which constitutes a necessary part of the first part unit when the first part unit is not connected to the second part unit, and the first part unit being structured so that the rotating member is selectively rotatable about the rotating shaft between a first position, where the necessary member is received in the body and the engaging section is exposed to the outside of the body when the first part unit and the second part unit are connected to each other, and a second position, where the engaging section is received in the body and the necessary member is exposed to the outside of the body when the first part unit is not connected to the second part unit.

2. The assembly unit for a toy according to claim 1, wherein the engaging section is either one of an engaging portion having a convex part and an engaging portion having a concave part that detachably engages with the engaging portion having the convex part, and the engaged section is the other one of the engaging portion having the convex part and the engaging portion having the concave part.

3. The assembly unit for a toy according to claim 2, wherein the engaging portion having the convex part comprises a base provided to the rotating member, a plate-like portion formed integrally with the base extending in the direction in which the plate-like portion extends away from the base, and an engaging-expanding portion formed integrally with the plate-like portion along the end of the plate-like portion, wherein the engaging portion having the concave part comprises a pair of flexible wall portions, which are spaced at a predetermined distance and sandwich the plate-like portion and the engaging-expanding portion therebetween, and along the end thereof, formed integrally with an engaged-expanding portion respectively the engaging-expanding portions preventing the engaging - expanding portion from coming off therebetween, and wherein, the engaging portion having the convex part further comprises a reinforcement portion disposed for connecting the base and the plate-like portion to reinforce the plate-like portion, the reinforcement portion being provided so as to allow the plate-like portion and the engaging-expanding portion to be inserted between the pair of wall portions of the engaging portion having the concave part.

4. A transformable toy including a toy assembly unit set forth in claim 3 as a part for transforming figure of the transformable toy.

5. A transformable toy including the first part unit of the toy assembly unit set forth in claim 3 as a basic portion.

6. A transformable toy including a toy assembly unit set forth in claim 2 as a part for transforming figure of the transformable toy.

7. A transformable toy including the first part unit of the toy assembly unit set forth in claim 2 as a basic portion.

8. The assembly unit for a toy according to claim 1, wherein the body has a hollow structure which includes a receiving space therein for receiving the necessary member or the engaging section, and a peripheral wall portion surrounding the receiving space of the body is structured so as to allow the rotating member to change its position between the first position and the second position about the rotating shaft.

9. A transformable toy including a toy assembly unit set forth in claim 8 as a part for transforming figure of the transformable toy.

10. A transformable toy including the first part unit of the toy assembly unit set forth in claim 8 as a basic portion.

11. The assembly unit for a toy according to claim 8, wherein a part of the peripheral wall portion is constructed from a door member that is opened at least in one of the cases that the rotating member rotates from the first position to the second position about the rotating shaft and that the rotating member rotates from the second position to the first position about the rotating shaft to allow the rotating member to rotate.

12. A transformable toy including a toy assembly unit set forth in claim 11 as a part for transforming figure of the transformable toy.

13. A transformable toy including the first part unit of the toy assembly unit set forth in claim 11 as a basic portion.

14. A transformable toy including a toy assembly unit set forth in claim 1 as a part for transforming figure of the transformable toy.

15. A transformable toy including the first part unit of the toy assembly unit set forth in claim 1 as a basic portion.

16. A transformable toy, comprising a plurality of part units each constructed being connected to each other via a connecting mechanism including an engaging section and an engaged section having a structure to be engaged with the engaging section, which transforms its figure by changing the connecting combination of the plurality of part units, by replacing a part of the plurality of part units with previously prepared other part unit using the connecting mechanism or by adding the previously prepared other part unit to the plurality of part units using the connecting mechanism, one of the plurality of part units connected via the connecting mechanism including a rotating member having a necessary member constituting a portion necessary for the one of the part units when the one of the part units is not connected to other part unit, a rotating member rotating about a rotating shaft provided to a body of the one of the part unit, the rotating member being provided with the engaging section, and the one of the part units being structured so that the rotating member is selectively rotatable about the rotating shaft between a first position, where the necessary member is received in the body and the engaging section is exposed to the outside of the body when the one of the part units and the other part unit are connected to each other, and a second position, where the engaging section is received in the body and the necessary member is exposed to the outside of the body when the one of the part units is not connected to the other part unit..

17. The transformable toy according to claim 16, wherein the one part unit itself constitutes an arm part, and wherein the necessary member is the hand.

18. The transformable toy according to claim 16, wherein the engaging section is either one of an engaging portion having a convex part and an engaging portion having a concave part that detachably engages with the engaging portion having the convex part, and the engaged section is the other one of the engaging portion having the convex part and the engaging portion having the concave part, wherein the engaging portion having the convex part comprises a base provided to the rotating member, a plate-like portion formed integrally with the base extending in the direction in which the plate-like portion extends away from the base, and an engaging-expanding portion formed integrally with the plate-like portion along the end of the plate-like portion, wherein the engaging portion having the concave part comprises a pair of flexible wall portions, which are spaced at a predetermined distance and sandwich the plate-like portion and the engaging-expanding portion therebetween, and along the end portion thereof, formed integrally with an engaged-expanding portion respectively the engaging-expanding portions preventing the engaging-expanding portion from coming off therebetween, and wherein, the engaging portion having the convex part further comprises, a reinforcement portion disposed for connecting the base and the plate-like portion to reinforce the plate-like portion, the reinforcement portion being provided so as to allow the plate-like portion and the engaging-expanding portion to be inserted between the pair of wall portions of the engaging portion having the concave part.

* * * * *